US008086446B2

(12) United States Patent
Oh et al.

(10) Patent No.: US 8,086,446 B2
(45) Date of Patent: Dec. 27, 2011

(54) METHOD AND APPARATUS FOR NON-OVERLAPPED TRANSFORMING OF AN AUDIO SIGNAL, METHOD AND APPARATUS FOR ADAPTIVELY ENCODING AUDIO SIGNAL WITH THE TRANSFORMING, METHOD AND APPARATUS FOR INVERSE NON-OVERLAPPED TRANSFORMING OF AN AUDIO SIGNAL, AND METHOD AND APPARATUS FOR ADAPTIVELY DECODING AUDIO SIGNAL WITH THE INVERSE TRANSFORMING

(75) Inventors: Eunmi Oh, Seoul (KR); Junghoe Kim, Seoul (KR); Boris Kudryashov, St. Petersburg (RU); Konstantin Osipov, St. Petersburg (RU)

(73) Assignee: Samsung Electronics Co., Ltd., Suwon-Si (KR)

( * ) Notice: Subject to any disclaimer, the term of this patent is extended or adjusted under 35 U.S.C. 154(b) by 615 days.

(21) Appl. No.: 11/295,648

(22) Filed: Dec. 7, 2005

(65) Prior Publication Data

US 2006/0122825 A1 Jun. 8, 2006

(30) Foreign Application Priority Data

Dec. 7, 2004 (KR) ..... 10-2004-0102303

(51) Int. Cl.
*G10L 19/02* (2006.01)

(52) U.S. Cl. ..... 704/203; 704/E19.01; 704/E19.012; 704/500; 704/501

(58) Field of Classification Search ..... 704/500, 704/501, E19.01, 203, E19.012
See application file for complete search history.

(56) References Cited

U.S. PATENT DOCUMENTS 5,214,742 A * 5/1993 Edler ..... 704/203
5,235,623 A * 8/1993 Sugiyama et al. ..... 375/241
5,394,473 A * 2/1995 Davidson ..... 704/200.1
5,481,614 A * 1/1996 Johnston ..... 381/2

(Continued)

FOREIGN PATENT DOCUMENTS

EP 0 620 653 A2 3/1994

(Continued)

OTHER PUBLICATIONS

J. Princen, J. Johnson, and A. Bradley, "Subband/transform coding using filter bank designs based on time domain aliasing cancellation," in Proc. Int. Conf. Acoustics, Speech, and Signal Processing (ICASSP-87), May 1987, pp. 50.1.1-50.1.4.*

(Continued)

*Primary Examiner* — Richemond Dorvil
*Assistant Examiner* — Greg Borsetti
(74) *Attorney, Agent, or Firm* — Staas & Halsey LLP

(57) ABSTRACT

A method and apparatus for transforming an audio signal, a method and apparatus for adaptively encoding an audio signal, a method and apparatus for inversely transforming an audio signal, and a method and apparatus for adaptively decoding an audio signal. The method of transforming an audio signal includes determining a transform unit into which the audio signal in a time domain is to be transformed into an audio signal in a frequency domain, and transforming the audio signal into an audio signal in the frequency domain according to the determined transform units using a window coefficient other than 0. Accordingly, it is possible to minimize distortion of the audio signal when encoding the audio signal even at a high bit rate while increasing efficiency of compression.

31 Claims, 13 Drawing Sheets

U.S. PATENT DOCUMENTS

| | | | | |
|---|---|---|---|---|
| 5,848,391 | A * | 12/1998 | Bosi et al. | 704/200.1 |
| 5,960,390 | A * | 9/1999 | Ueno et al. | 704/200.1 |
| 6,226,608 | B1 * | 5/2001 | Fielder et al. | 704/229 |
| 6,453,282 | B1 * | 9/2002 | Hilpert et al. | 704/200.1 |
| 6,772,111 | B2 * | 8/2004 | Araki | 704/200.1 |
| 7,003,448 | B1 * | 2/2006 | Lauber et al. | 704/200.1 |
| 7,283,968 | B2 * | 10/2007 | Youn | 704/500 |
| 2003/0115052 | A1 * | 6/2003 | Chen et al. | 704/230 |
| 2004/0158472 | A1 * | 8/2004 | Voessing | 704/500 |
| 2004/0181403 | A1 * | 9/2004 | Hsu | 704/230 |
| 2005/0071402 | A1 * | 3/2005 | Youn | 708/402 |

FOREIGN PATENT DOCUMENTS

| | | |
|---|---|---|
| WO | WO 98/02971 | 1/1998 |

OTHER PUBLICATIONS

Harris, FJ. On the use of Windows for harmonic analysis with the discrete fourier transform. Proc of the IEEE 1978;66:51-83.*

J. Herre and J. Johnston, "Enhancing the performance of perceptual audio coders by using temporal noise shaping (TNS)," in Proc. 101st Conv. Aud. Eng. Soc., 1996, preprint 4384.*

Wang, Y., Vilermo, M., "Modified Discrete Cosine Transform—Its Implications for Audio Coding and Error Concealment," Journal of Audio Engineering Society, vol. 51, No. 1/2, pp. 52-62, Jan./Feb. 2003.*

Johnston et al. "MPEG Audio Coding" 2002.*

Liu et al. "Design of MPEG-4 AAC Encoder" Oct. 28-31, 2004.*

Zhaorong et al. "New Window-Switching Criterion of Audio Compression" 2001.*

"Universal Mobile Telecommunications System (UMTS); Audio codec processing functions; Extended Adaptive Multi-Rate-Wideband (AMR-WB+) codec; Transcoding functions (3GPP TS 126 290" ETSI Strandards, LIS, Sophiaantipolis Cedexd, France, vol. 3-SA4, No. V6.1.0, Dec. 1, 2004.

Extended European Search Report mailed on Jul. 30, 2008 issued with respect to the corresponding European Patent Application No. 05257500.8-1224.

Chinese Patent First Office Action mailed Sep. 25, 2009 corresponding to Chinese Patent Application 200510127926.8.

"3rd Generation Partnership Project; Technical Specification Group Service and System Aspects; Audio Codec Processing Functions; Extended AMR Wideband Codec; Transcoding Functions (Release 6)," 3GPP TS 26.290 V6.0.0 (Sep. 2004) pp. 1-86.

Japanese Office Action mailed Jul. 5, 2011 corresponds to Japanese Patent Application No. 2005-352938.

* cited by examiner

FIG. 1 (PRIOR ART)

| FRAME TYPE | TOTAL NUMBER OF FREQUENCY DOMAIN COEFFICIENTS | FRAME SHAPE |
|---|---|---|
| LONG_FRAME | 1024 | |
| SHORT_FRAME | 128 | |
| LONG_START_FRAME | 1024 | |
| LONG__STOP_FRAME | 1024 | |

FIG. 4

| FRAME TYPE | LENGTH IN FREQUENCY DOMAIN | LENGTH IN TIME DOMAIN |
|---|---|---|
| SUPERIONG ($F_1$) | 2048 | 4096 |
| LONG ($F_2$) | 1024 | 2048 |
| SHORT ($F_3$) | 512 | 1024 |
| SUPERSHORT ($F_4$) | 128 | 256 |
| TRANSITION BETWEEN SUPERIONG AND LONG ($T_1$) | 1536 | 3072 |
| TRANSITION BETWEEN SUPERIONG AND SHORT ($T_2$) | 1280 | 2560 |
| TRANSITION BETWEEN LONG AND SHORT ($T_3$) | 768 | 1536 |
| TRANSITION BETWEEN LONG AND SUPER SHORT ($T_4$) | 576 | 1152 |
| TRANSITION BETWEEN SHORT AND SUPERSHORT ($T_5$) | 320 | 640 |

METHOD AND APPARATUS FOR NON-OVERLAPPED TRANSFORMING OF AN AUDIO SIGNAL, METHOD AND APPARATUS FOR ADAPTIVELY ENCODING AUDIO SIGNAL WITH THE TRANSFORMING, METHOD AND APPARATUS FOR INVERSE NON-OVERLAPPED TRANSFORMING OF AN AUDIO SIGNAL, AND METHOD AND APPARATUS FOR ADAPTIVELY DECODING AUDIO SIGNAL WITH THE INVERSE TRANSFORMING

CROSS-REFERENCE TO RELATED APPLICATION

This application claims the priority of Korean Patent Application No. 10-2004-0102303, filed on Dec. 7, 2004, in the Korean Intellectual Property Office, the disclosure of which is incorporated herein by reference.

BACKGROUND OF THE INVENTION

1. Field of the Invention

The present invention relates to encoding and decoding of an audio signal, and more particularly, to an apparatus and method for transforming an audio signal by selecting a frame of frames of various lengths according to a change in an audio signal, and transforming, encoding, and decoding the audio signal in units of the selected frame using a window coefficient other than 0; an apparatus and method for encoding an audio signal adaptively to a change in the audio signal; an apparatus and method for inversely transforming an audio signal, and an apparatus and method for decoding an audio signal adaptively to a change in the audio signal.

2. Description of Related Art

Conventionally, an audio signal is encoded by transforming it into units of a predetermined frame, and generating a bit stream by changing a bit rate of the transformed audio signal by the quantizing the transformed audio signal. The length of a frame of an audio signal must be determined by the degree that the audio signal changes. Specifically, the frame length of an audio signal that changes fast in a time domain must be determined to be smaller so that the audio signal can be processed into a frequency domain over a broad band of frequency, thereby generating a more precise bit stream. In contrast, the frame length of an audio signal that changes slowly in the time domain must be determined to be larger so that the audio signal can be processed into the frequency domain over a narrow band of frequency, thereby reducing consumption of frequency resources.

Conventionally, the types of frames are limited, for example, frames are categorized into a long frame and a short frame. Therefore, an audio signal that rapidly changes to a large extent is encoded using oversampled transform, thereby causing distortion of the encoded audio signal.

FIG. 1 is a table illustrating conventional frame types and related window coefficients. Referring to FIG. 1, there are a long frame and a short frame, and a long start frame and a long stop frame that are obtained by transforming the long and short frames, respectively. When performing a windowing operation on the long start frame and the long stop frame, they have a window coefficient of 0.

FIG. 2 is a graph illustrating transforming of an audio signal, which has a window coefficient of 0, into a frequency domain using the windowing operation.

A method of transforming and inversely transforming an audio signal will now be described briefly. Typically, an audio signal is transformed into a frequency domain using a Modified Discrete Cosine Transform (MDCT). According to the MDCT, a z signal is obtained by multiplying input data on a time axis by a window coefficient illustrated in FIG. 2. Next, a final frequency-domain spectrum is computed by substituting the value of the z signal for the following equation:

$$X_{i,k} = 2 \cdot \sum_{n=0}^{N-1} z_{i,n} \cos\left(\frac{2\pi}{N}(n+n_0)\left(k+\frac{1}{2}\right)\right) \text{ for } 0 \le k < N/2, \tag{1}$$

wherein $X_{i,k}$ denotes the value of a frequency domain, $z_{in}$ denotes a windowed input sequence, n denotes the index of a sample unit, k denotes the index of a spectral coefficient, i denotes a frame index, N denotes the length of a frame, and $n_0$ denotes (N/2+1)/2.

The encoded audio signal is inversely transformed into a time domain using the following equation:

$$x_{i,n} = \frac{2}{N} \sum_{k=0}^{\frac{N}{2}-1} spec[i][k] \cos\left(\frac{2\pi}{N}(n+n_0)\left(k+\frac{1}{2}\right)\right) \text{ for } 0 \le n < N, \tag{2}$$

wherein $x_{i,n}$ denotes the value obtained by inversely transforming the encoded audio signal.

As described above, conventionally, when using the MDCT to transform an audio signal into a frequency domain, a portion of a first frame unit of the audio signal ranging from 1538+128 to 2048 of the time axis is transformed using a window coefficient of 0. Frame samples obtained in this case are multiplied by the window coefficient of 0, and thus, the results of multiplication are neglected. Although 1024 spectrum values are obtained by using the first frame unit according to the characteristics of the MDCT, the effect of the MDCT is lowered when the window coefficient is 0.

BRIEF SUMMARY

An aspect of the present invention provides a method of transforming an audio signal using a window coefficient other than 0.

An aspect of the present invention also provides a method of transforming an audio signal into units of a frame selected according to a change in the audio signal.

An aspect of the present invention also provides a method of encoding an audio signal into units of frames selected according to a change in the audio signal.

An aspect of the present invention also provides an apparatus for transforming an audio signal using a window coefficient of 0.

An aspect of the present invention also provides an apparatus for transforming an audio signal into units of a frame selected according to a change in the audio signal.

An aspect of the present invention also provides an apparatus for encoding an audio signal into units of a frame selected according to a change in the audio signal.

An aspect of the present invention also provides a method of inversely transforming an audio signal that is encoded using a window coefficient of 0.

An aspect of the present invention also provides a method of inversely transforming audio signal encoded into units of a frame selected according to a change in the audio signal.

An aspect of the present invention also provides a method of decoding an audio signal encoded into units of a frame selected according to a change in the audio signal.

An aspect of the present invention also provides an apparatus for inversely transforming an audio signal encoded using a window coefficient of 0.

An aspect of the present invention also provides an apparatus for inversely transforming an audio signal that is encoded into units of a frame selected according to a change in the audio signal.

An aspect of the present invention also provides an apparatus for decoding an audio signal encoded into units of a frame selected according to a change in the audio signal.

According to one embodiment of the present invention, there is provided a method of transforming an audio signal, the method including: determining a transform unit into which the audio signal is to be transformed into an audio signal in a frequency domain; and transforming the audio signal in a time domain into an audio signal in the frequency domain according to the determined transform units, using a window coefficient other than 0.

According to another embodiment of the present invention, there is provided a method of transforming an audio signal, the method including: filtering the audio signal into predetermined sample units; determining an adaptive transform unit into which the audio signal is to be transformed into an audio signal in a frequency domain, when the size of the audio signal becomes greater than a predetermined threshold; and transforming the audio signal into an audio signal in the frequency domain according to the determined adaptive transform units.

According to yet another embodiment of the present invention, there is provided a method of adaptively transforming an audio signal, the method including: filtering the audio signal into predetermined sample units; determining an adaptive transform unit into which the audio signal is to be transformed into a frequency domain when the size of the audio signal is greater than a predetermined threshold; transforming the audio signal into an audio signal in the frequency domain according to the determined adaptive transform units; quantizing the audio signal transformed into the frequency domain; and encoding the quantized audio signal.

According to still another embodiment of the present invention, there is provided an apparatus for transforming an audio signal, the apparatus including: a transform unit determiner determining a transform unit into which the audio signal is to be transformed into an audio signal in a frequency domain; and a frequency-domain transformer transforming the audio signal in a time domain into the audio signal in the frequency domain according to the determined transform units, using a window coefficient other than 0.

According to still another embodiment of the present invention, there is provided an apparatus for transforming an audio signal, the apparatus including: a filtering unit filtering the audio signal into predetermined sample units; an adaptive transform unit determiner determining an adaptive transform unit into which the audio signal is to be transformed into an audio signal in a frequency domain when a size of the audio signal is greater than a predetermined threshold; and a frequency-domain transformer transforming the audio signal into an audio signal in the frequency domain according to the determined adaptive transform units.

According to still another embodiment of the present invention, there is provided an apparatus for adaptively transforming an audio signal, the apparatus including: a filtering unit filtering the audio signal into predetermined sample units; an adaptive transform unit determiner determining an adaptive transform unit into which the audio signal is to be transformed into the frequency domain when the size of the audio signal is greater than a predetermined threshold; a frequency-domain transformer transforming the audio signal into an audio signal in the frequency domain according to the determined adaptive transform units; a quantization unit quantizing the audio signal transformed into the frequency domain; a bit rate controller controlling the bit rate of the audio signal to be quantized; and an encoding unit encoding the quantized audio signal.

According to still another embodiment of the present invention, there is provided a method of inversely transforming an audio signal, the method including: inversely transforming an audio data which is a bit stream of the audio signal transformed into a frequency domain using a window coefficient other than 0.

According to still another embodiment of the present invention, there is provided a method of inversely transforming an audio signal, the method including: detecting information regarding an adaptive transform unit of the audio signal transformed into a frequency domain, from audio data; and inversely transforming the audio data according to the adaptive transform units of the detected information.

According to still another embodiment of the present invention, there is provided a method of decoding an audio signal, the method including: decoding encoded audio data; inversely quantizing the decoded audio data; detecting information regarding an adaptive transform unit of the audio signal transformed into a frequency domain, from the inversely quantized audio data; and inversely transforming the audio data according to the adaptive transform units of the detected information.

According to still another embodiment of the present invention, there is provided an apparatus for inversely transforming an audio signal, the apparatus including: a time-domain inverse transformer inversely transforming audio data which is a bit stream of the audio signal transformed into a frequency domain using a window coefficient other than 0.

According to still another embodiment of the present invention, there is provided an apparatus for inversely transforming an audio signal, the apparatus including: a transform unit information detector detecting information regarding an adaptive transform unit of the audio signal transformed into a frequency domain, from audio data; and a time-domain inverse transformer inversely transforming the audio data according to the adaptive transform units of the detected information.

According to still another embodiment of the present invention, there is provided a apparatus for adaptively decoding an audio signal, the apparatus including: a decoding unit decoding encoded audio data; an inverse quantization unit inversely quantizing the decoded audio data; a transform unit information detector detecting information regarding an adaptive transform unit of the audio signal transformed into a frequency domain, from the inversely quantized audio data; and a time-domain inverse transformer inversely transforming the audio data according to the adaptive transform units of the detected information.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which:

FIG. 1 is a table illustrating conventional frame types and related window coefficients;

FIG. 4 is a table illustrating various types of frames available when an audio signal is transformed according to an embodiment of the present invention;

DETAILED DESCRIPTION OF THE PREFERRED EMBODIMENTS

Figure 2:
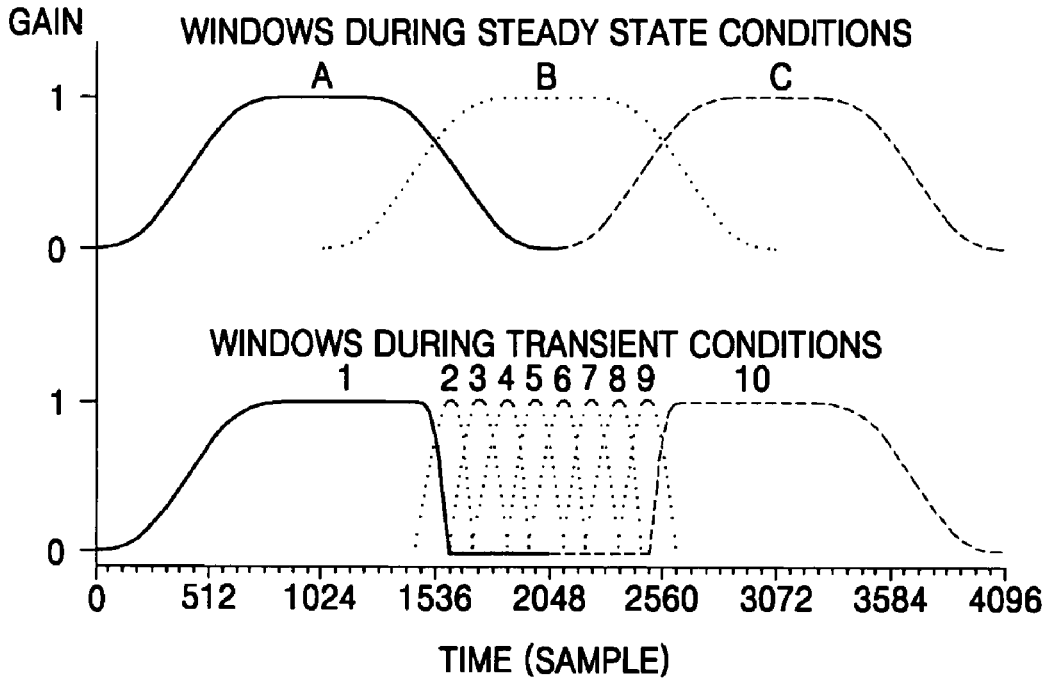
FIG. 2 (PRIOR ART)
FIG. 2 is a graph illustrating transforming of an audio signal, which has a window coefficient of 0, into a frequency domain using a windowing operation.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 3:
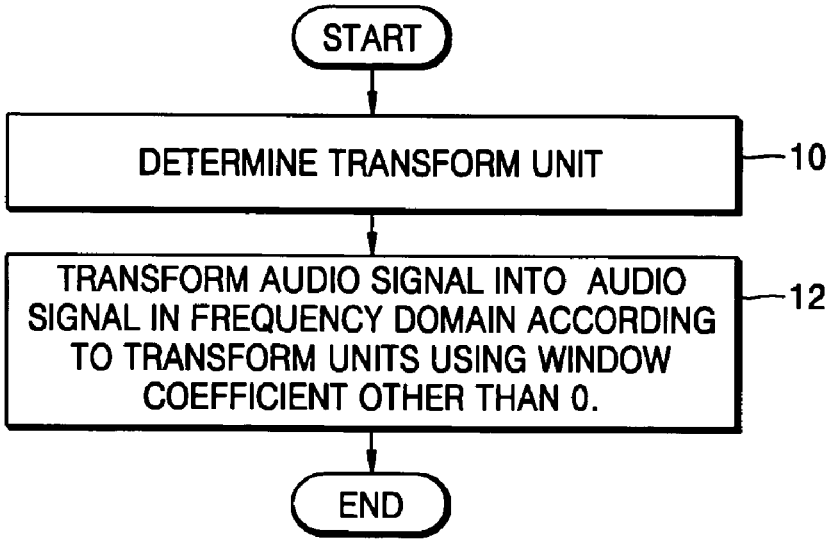
FIG. 3 is a flowchart of a method of transforming an audio signal into a frequency domain according to an embodiment of the present invention.

FIG. 3 is a flowchart of a method of transforming an audio signal into a frequency domain according to an embodiment of the present invention. Referring to FIG. 3, a frame into which the audio signal is to be transformed into a frequency domain is determined (operation 10).

FIG. 4 is a table illustrating various types of frames available when an audio signal is transformed, according to an embodiment of the present invention. When a unit into which the audio signal is transformed is determined to be a frame, one of frames of various lengths is selected according to a change in the audio signal.

Returning to FIG. 3, after operation 10, the audio signal is transformed into the frequency domain according to the determined transform units, using a window coefficient other than 0 (operation 12).

Figure 5:
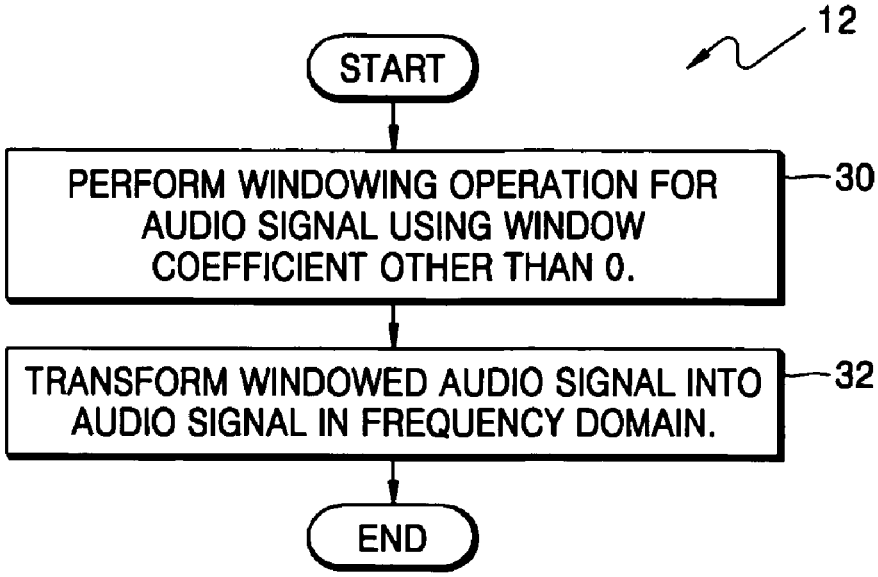
FIG. 5 is a detailed flowchart of operation 12 illustrated in FIG. 3.

FIG. 5 is a detailed flowchart of operation 12 illustrated in FIG. 3. Referring to FIG. 5, a windowing operation is performed on the audio signal according to the determined transform units, using a window coefficient other than 0 (operation 30). The determined transform units are just frame units. The windowing operation is a technique used to minimize discontinuity of information between frames and distortion of information caused when an audio signal is divided into frame units. The windowing operation uses a window coefficient determined such that the original audio signal can be restored by inversely transforming a transformed audio signal using a Modified Discrete Cosine Transform (MDCT). Conventionally, a sine window coefficient or a Kaiser-Bessel window coefficient used in an audio codec MPEG-4 AAC/BSAC/TwinVQ was used as a window coefficient. However, a window coefficient used in the present embodiment is a value other than 0. In operation 30, the windowing operation may be performed on an audio signal into units of a frame which is selected from the frames illustrated in FIG. 4, using a window coefficient other than 0. Since a window coefficient of 0 is not used, it is possible to prevent a reduction in an effect of transforming an audio signal.

After operation 30, the windowed audio signal is performed is transformed into an audio signal in a frequency domain (operation 32). Discrete Cosine Transform (DCT) or the MDCT may be used to transform the windowed audio signal.

Figure 6:
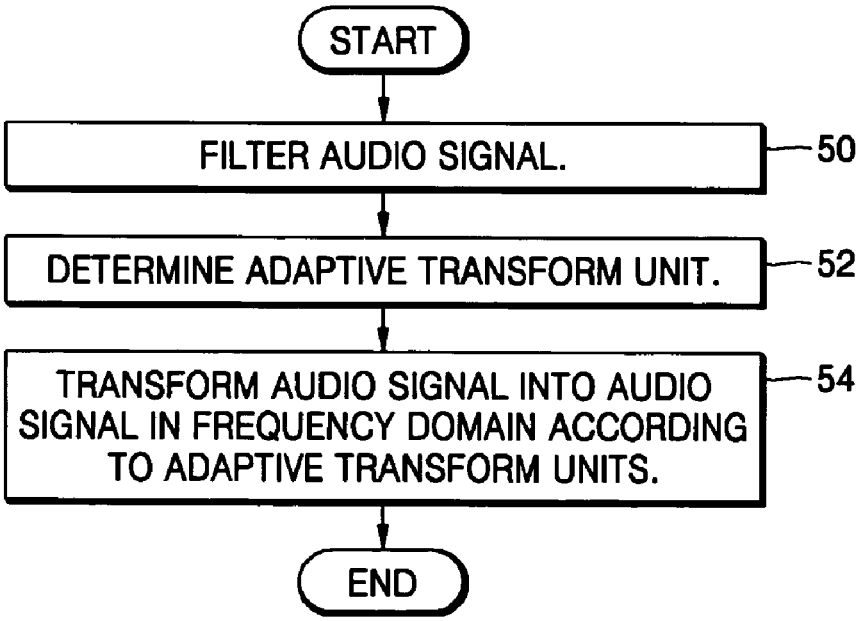
FIG. 6 is a flowchart of a method of transforming an audio signal according to another embodiment of the present invention.
Figure 7:
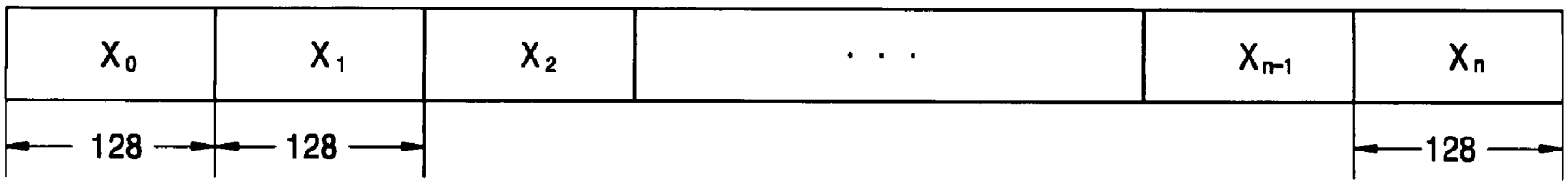
FIG. 7 is a view of an audio signal filtered into units of a predetermined frame according to an embodiment of the present invention, explaining operation 50 illustrated in FIG. 6.

FIG. 6 is a flowchart of a method of transforming an audio signal into a frequency domain according to another embodiment of the present invention. Referring to FIG. 6, the audio signal is filtered into predetermined sample units (operation 50). In operation 50, filtering is performed on required portions of the audio signal according to a frequency band. The predetermined sample units indicate units of length into which a sampled audio signal can be divided. FIG. 7 is a view of an audio signal filtered into predetermined frames, explaining operation 50 illustrated in FIG. 6. Referring to FIG. 7, the audio signal is divided and filtered into sample units of 128. In FIG. 7, $X_1$ through $X_n$ denote the index marks of the 128-bit sample units into which the audio signal is filtered, respectively.

After operation 50, when the size of the audio signal becomes greater than a predetermined threshold, an adaptive transform unit into which the audio signal is to be transformed into a frequency domain is determined (operation 52). The predetermined threshold is a reference value used in determining whether the audio signal rapidly changes to a large extent. The adaptive transform unit is a unit into which the audio signal can be transformed into a frequency domain while minimizing distortion of the audio signal, determined when the audio signal rapidly changes to a large extent. The length of the adaptive transform unit may be variously determined as illustrated in FIG. 4. The adaptive transform unit may be selected from a super long frame $F_1$, a long frame $F_2$, a short frame $F_3$, and a super short frame $F_4$. In FIG. 4, $T_1$, $T_2$, $T_3$, $T_4$, and $T_5$ denote frames obtained by transforming these frames $F_1$ through $F_4$. The present invention is not, however, limited to these frames, that is, frames of various lengths can be used in transforming an audio signal.

Figure 8:
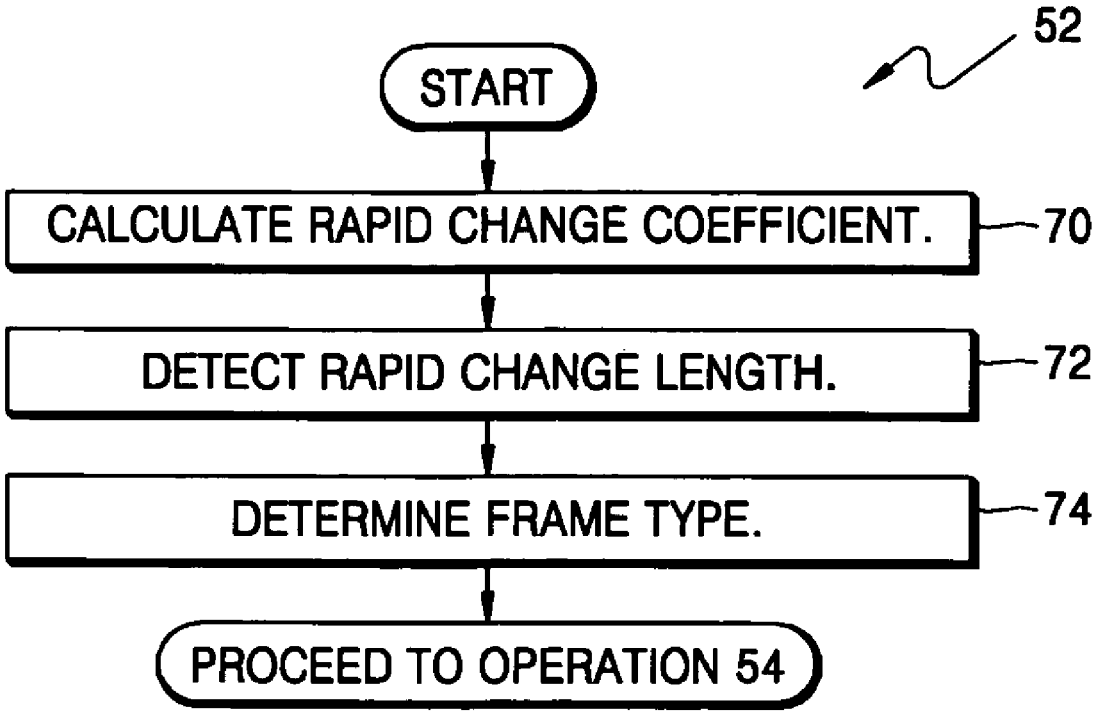
FIG. 8 is a detailed flowchart of operation 52 illustrated in FIG. 6.

FIG. 8 is a detailed flowchart of operation 52 illustrated in FIG. 6. Referring to FIG. 8, a rapid change coefficient corresponding to the degree of a change in the filtered audio signal is computed (operation 70). The rapid change coefficient is used in determining whether the filtered audio signal rapidly changes to a large extent. For instance, a rapid change coefficient of each of sample units $X_1$ through $X_n$, illustrated in FIG. 7, into which the audio signal is filtered is computed. Specifically, representative values $y_1$ through $y_n$ of the sample units $X_1$ through $X_n$ are determined. Each of the representative values $y_1$ through $y_n$ is the largest value of each of the sample units $X_1$ through $X_n$. Next, a rapid change coefficient of each of the representative values $y_1$ through $y_n$ is computed by:

$$A_k=y_k/M_k. \quad (3),$$

wherein $A_k$ denotes a rapid change coefficient of the sample unit $X_k$, $Y_k$ denotes a representative value of the sample unit $X_k$, and $M_k$ denotes an average value of representative values $Y_1$ through $Y_{k-1}$ of the sample units $X_0$ through $X_{k-1}$.

As shown in Equation (3), when a rapid change coefficient is large, the audio signal is considered as rapidly changing to a large extent at a frame of the audio signal where the rapid change coefficient is obtained.

After operation 70, if the rapid change coefficient is greater than the predetermined threshold, a rapid change length of the audio signal that begins to rapidly change to a large extent is measured (operation 72). As described above, the predetermined threshold is a reference value used in determining whether the audio signal rapidly changes to a large extent. The rapid change length corresponds to the difference between the positions of the beginning frame of the audio signal and the frame of the audio signal that begins to rapidly change to a large extent in the time domain. That the rapid change coefficient is greater than the predetermined threshold indicates that the audio signal rapidly changes to a large extent at a point where the rapid change coefficient is obtained. For instance, the rapid change length is computed by multiplying a value of 128 of the sample unit by the value of k of the sample unit $X_k$ at which the rapid change coefficient is obtained. That is, the rapid change length is computed by:

$$B_k=128\times k \quad (4),$$

wherein $B_k$ denotes the rapid change length, 128 denotes the value of the sample unit of the audio signal, and k denotes the value of the subscript k of the sample unit $X_k$ at which the rapid change coefficient is obtained.

After operation 72, the type of a frame into which the audio signal is to be transformed is determined by comparing the rapid change length with the sums of the lengths of various types of frames (operation 74).

Figure 9:
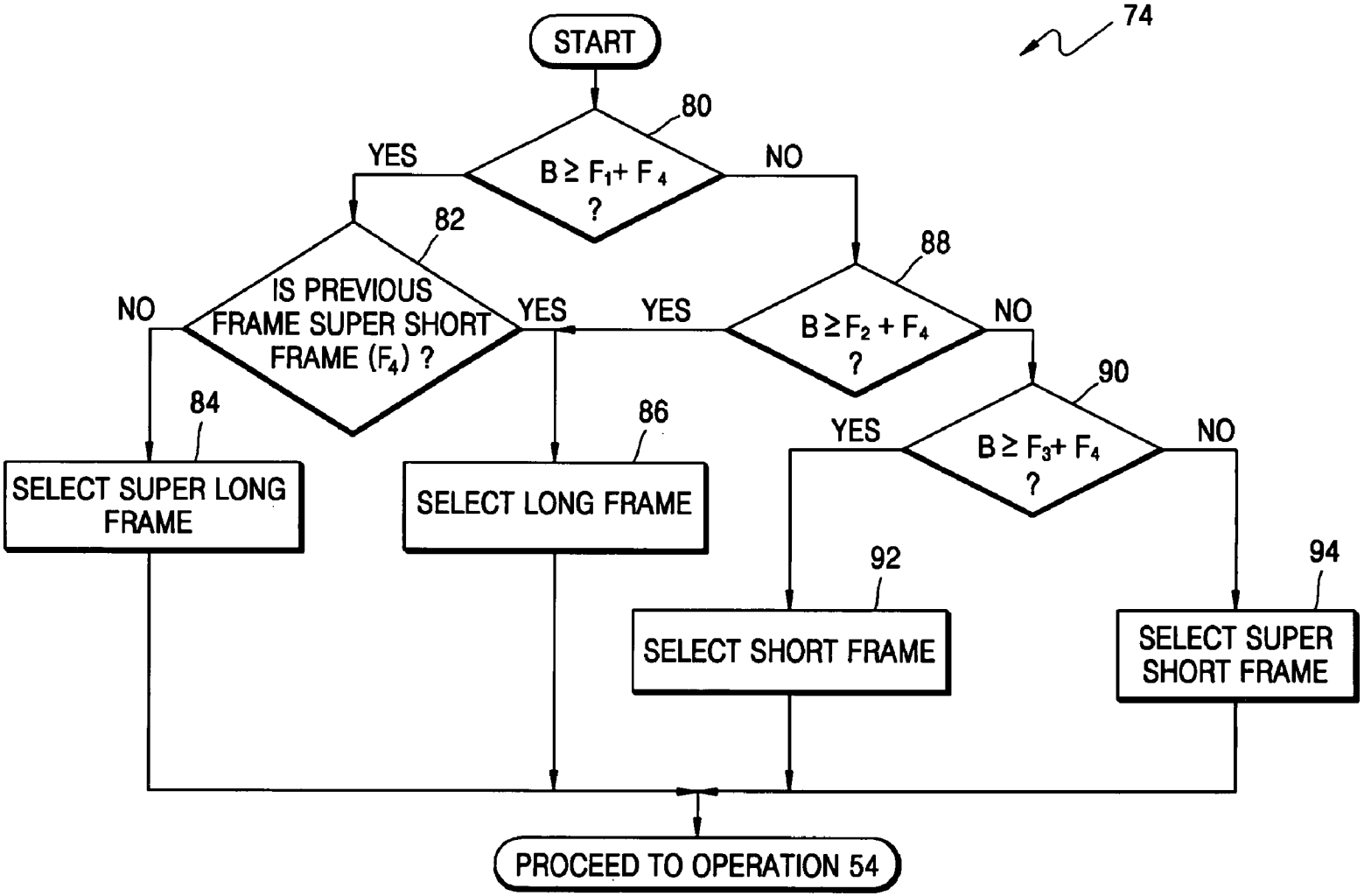
FIG. 9 is a detailed flowchart of operation 74 illustrated in FIG. 8.

FIG. 9 is a detailed flowchart of operation 74 illustrated in FIG. 8. Referring to FIG. 9, it is determined whether the length of the frames of the audio signal that begins to rapidly change to a large extent is equal to or greater than the sum of the lengths of a super long frame and a super short frame (operation 80). For instance, referring to FIG. 4, it is determined whether the length $B_k$ is equal to or greater than the sum of the lengths of the super long frame $F_1$ and the super short frame $F_4$.

If the length $B_k$ is equal to or greater than the sum of the lengths of the super long frame $F_1$ and the super short frame $F_4$, it is determined whether a previous frame into the audio signal was transformed are the super short frame (operation 82). For instance, when the length $B_k$ is equal to or greater than the sum of the lengths of the super long frame $F_1$ and the super short frame $F_4$, the total length of the sample units $X_1$ through $X_k$ is very likely to be greater than at least the length of the super long frame $F_1$. Accordingly, if the rapid change length is equal to or greater than the sum of the lengths of the super long frame and the super short frame, the super long frame or the super short frame is selected as a frame into which the audio signal is to be transformed.

If the previous frame is not the super short frame, the super long frame is selected as a frame into which the audio signal will be transformed into the frequency domain (operation 84). For instance, when the previous frame is not the super short frame $F_4$ of FIG. 4, it means that a rapid change does not occur in the previous frame. In this case, even if the super long frame $F_1$ is selected, the audio signal would not distort when the audio signal is encoded. Accordingly, if the previous frame is not the super short frame $F_4$, the super long frame $F_1$ is selected as a frame into which the audio signal is to be transformed.

However, when the previous frame is the super short frame, the long frame is selected (operation 86). For instance, when the previous frame is the super short frame $F_4$, it is understood that a sudden change occurred in at least the previous frame. In this case, it is better to select the long frame $F_2$ than the super long frame $F_1$ in order to minimize distortion of the audio signal when the audio signal is encoded.

If the rapid change length is less than the sum of the lengths of the super long frame and the super short frame, it is determined whether the length of the frames of the audio signal that begins to rapidly change to a large extent is equal to or greater than the sum of the lengths of the super long frame and the super short frame (operation 88). For instance, when the length $B_k$ is less than the sum of the lengths of the super long frame $F_1$ and the super short frame $F_4$, the total length of the sample units $X_1$ through $X_k$ is very likely to be less than the length of the super long frame $F_1$. In this case, it is determined whether the length $B_k$ is equal to or greater than the sum of the lengths of the long frame $F_2$ and the super short frame $F_4$.

If the rapid change length is equal to or greater than the sum of the lengths of the long frame and the super short frame, the method of FIG. 6 proceeds to operation 86, and the long frame is selected. For instance, when the length $B_k$ is equal to or greater than the sum of the lengths of the long frame $F_2$ and the super short frame $F_4$, the total length of the sample units $X_1$ through $X_k$ is greater than at least the length of the short frame $F_3$, and the long frame $F_2$ is selected.

However, when the rapid change length is less than the sum of the lengths of the long frame and the super short frame, it is determined whether the rapid change length is equal to or larger than the sum of the lengths of the short frame and the super short frame (operation 90). For instance, when the length $B_k$ is less than the sum of the lengths of the long frame $F_2$ and the super short frame $F_4$, the total length of the sample units $X_1$ through $X_k$ is very likely to be less than the length of the long frame $F_2$. Thus, the length of the frames of the audio signal that begins to rapidly change to a large extent is equal to or greater than the sum of the lengths of the short frame and the super short frame.

If the rapid change length is equal to or greater than the sum of the lengths of the short frame and the super short frame, the short frame is selected (operation 92). For instance, when the length $B_k$ is equal to or greater than the sum of the lengths of the short frame $F_3$ the super short frame $F_4$, the total length of the sample units $X_1$ through $X_k$ is greater than at least the length of the super short frame $F_4$. Therefore, the short frame $F_3$ is selected.

However, if the rapid change length is less than the sum of the lengths of the short frame and the super short frame, the super short frame is selected (operation 94). For instance, when the length $B_k$ is less than the sum of the lengths of the short frame $F_3$ and the super short frame $F_4$, the total length of the sample units $X_1$ through $X_k$ is very likely to be less than the length of the short frame $F_3$. Thus, when the rapid change length is less than the sum of the lengths of the short frame and the super short frame, the super short frame $F_4$ is selected.

Operation 74 illustrated in FIG. 9 is a non-limiting example. Therefore, a frame into which an audio signal is to be transformed into a frequency domain can be determined using various methods. For instance, in operation 80 of FIG. 9, the length of the frames of the audio signal that begins to remarkably change to a large extent may be compared with the sum of the lengths of the super long frame and the short frame or the sum of the lengths of the super long frame, the super short frame, and the short frame, not with the sum of the lengths of the super long frame and the super short frame.

Returning to FIG. 6, after operation 52, the audio signal is transformed into the frequency domain into units of the determined frame (operation 54).

Figure 10:
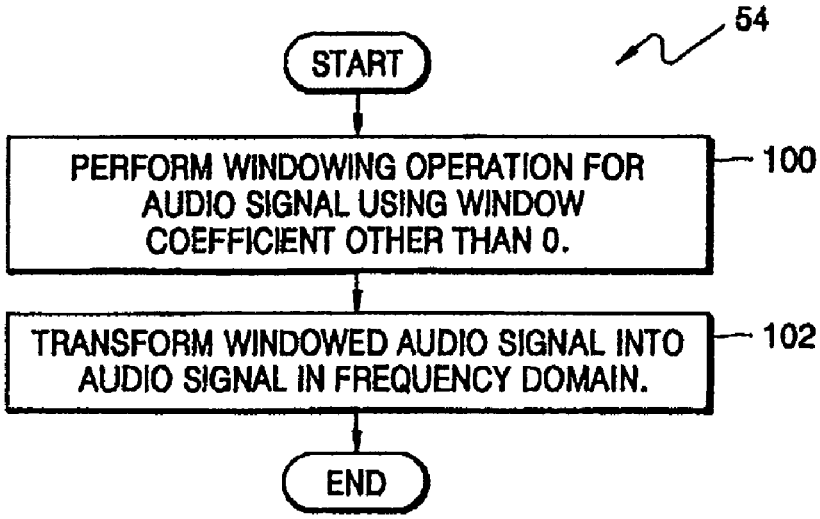
FIG. 10 is a detailed flowchart of operation 54 illustrated in FIG. 6.

FIG. 10 is a detailed flowchart of operation 54 illustrated in FIG. 6. Referring to FIG. 10, the windowing operation is performed on the audio signal using a window coefficient other than 0 (operation 100). According to the present embodiment, a window coefficient of 0 is not used in the windowing operation unlike in the conventional art. Also, a frame is selected as an adaptive frame unit from various types of frames, and the windowing operation is performed on the audio signal in units of the selected frame using a window coefficient other than 0. Accordingly, according to the present embodiment, an audio signal is transformed using a critically sampled transform, not an over sampled transform used in the prior art, thereby minimizing distortion of the audio signal when the audio signal is encoded.

After operation 100, the windowed audio signal is transformed into a frequency domain (operation 102). In operation 102, the DCT or the MDCT may be used to transform the audio signal into the frequency domain.

Figure 11:
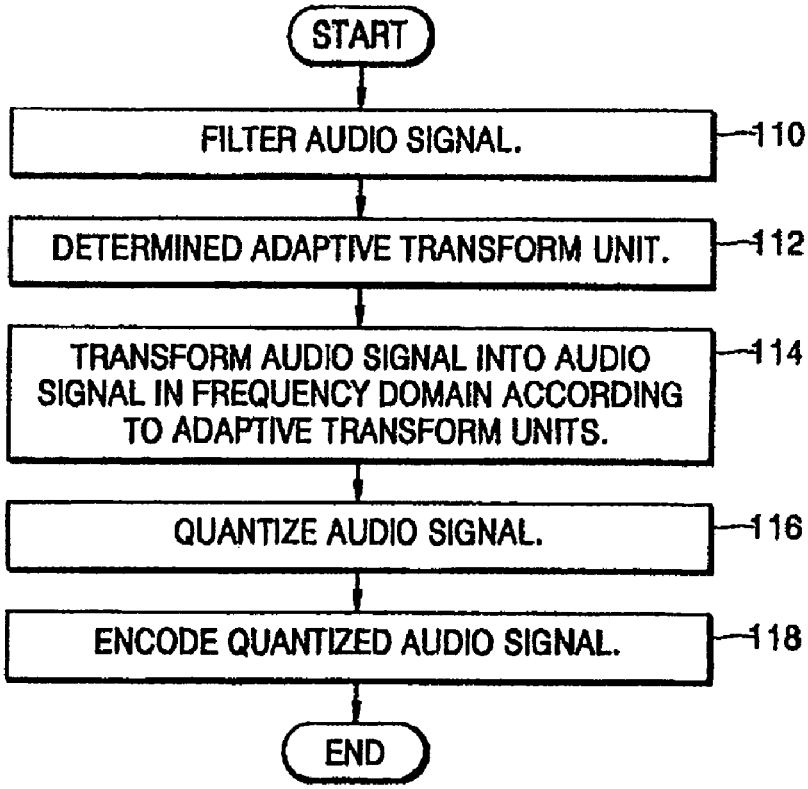
FIG. 11 is a flowchart of a method of adaptively encoding an audio signal according to an embodiment of the present invention.

A method of adaptively encoding an audio signal according to an embodiment of the present invention will now be described with reference to FIG. 11. Referring to FIG. 11, the audio signal is filtered into predetermined sample units (operation 110). In operation 110, filtering is performed on required portions of the audio signal according to a frequency band. A method of filtering the audio signal has already been described as above.

After operation 110, when the size of the audio signal becomes greater than a predetermined threshold, an adaptive transform unit into which the audio signal is to be transformed into the frequency domain is determined (operation 112). A detailed description of operation 112 has already been described as above.

After operation 112, the audio signal is transformed into the frequency domain into units of the determined adaptive transform unit (operation 114). A method of transforming the audio signal into the determined frame using a window coefficient other than 0 has already been described as above.

After operation 114, the audio signal transformed into the frequency domain is quantized (operation 116). Specifically, in operation 114, the audio signal transformed into a frequency substance in the frequency domain is quantized at a bit rate according to bit allocation information.

After operation 116, the quantized audio signal is encoded (operation 118). In other words, in operation 118, a stream of encoded bits is obtained by encoding the quantized audio signal. Lossy compression or lossless compression may be used to encode the quantized audio signal. In the lossless compression, the quantized audio signal is encoded by computing an appropriate probability distribution of the quantized audio signal and encoding the probability distribution using Huffman coding or arithmetic coding.

An apparatus for transforming an audio signal according to an embodiment of the present invention will now be described with reference to FIG. 12. The apparatus includes a transform unit determiner 200 and a frequency-domain transformer 220. The transform unit determiner 200 determines a unit into which the audio signal is to be transformed, and provides the determined unit to the frequency-domain transformer 220. If the determined unit is a frame, the transform unit determiner 200 is capable of selecting a frame from frames of different lengths according to a change in the audio signal. If the frames are the super long frame $F_1$, the long frame $F_2$, the short frame $F_3$, and the super short frame $F_4$ illustrated in FIG. 4, the transform unit determiner 200 selects one of the super long frame $F_4$ the long frame $F_2$, the short frame $F_3$, and the super short frame $F_4$ according to a rapid change in the audio signal.

The frequency-domain transformer 220 transforms the audio signal in a time domain into the frequency domain into units of the frame selected by the transform unit determiner 200, using a window coefficient other than 0.

Figure 12:
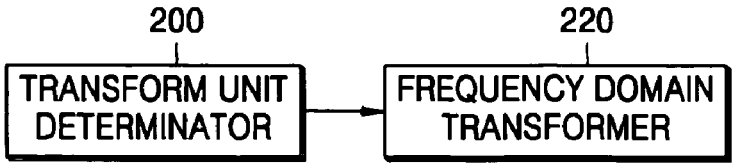
FIG. 12 is a block diagram of an apparatus for transforming an audio signal according to an embodiment of the present invention.
Figure 13:
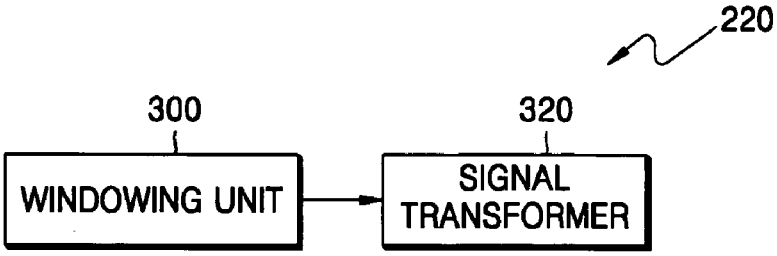
FIG. 13 is a block diagram of a frequency domain transformer illustrated in FIG. 12.

FIG. 13 is a detailed block diagram of the frequency-domain transformer 220 illustrated in FIG. 12. Referring to FIG. 13, the frequency-domain transformer 220 includes a windowing unit 330 and a signal transformer 320.

The windowing unit 300 performs a windowing operation on the audio signal into units of the determined frame using a window coefficient other than 0, and outputs the result of operation to the signal transformer 320. The window coefficient used by the windowing unit 300 is determined such that the original audio signal is restored through the MDCT that is an inverse transform. Conventionally, the sine window coefficient or the Kaiser-Bessel window coefficient used in an audio codec MPEG-4 AAC/BSAC/TwinVQ was used as a window coefficient, but the windowing unit 300 does not use a window coefficient of 0. In other words, the windowing unit 300 performs the windowing operation using a window coefficient other than 0, thereby preventing a reduction in an effect of transforming the audio signal.

The signal transformer 320 transforms the audio signal windowed by the windowing unit 300 into the frequency domain, using the DCT of the MDCT.

An apparatus for transforming an audio signal according to the present invention will now be described with the accompanying drawings.

Figure 14:
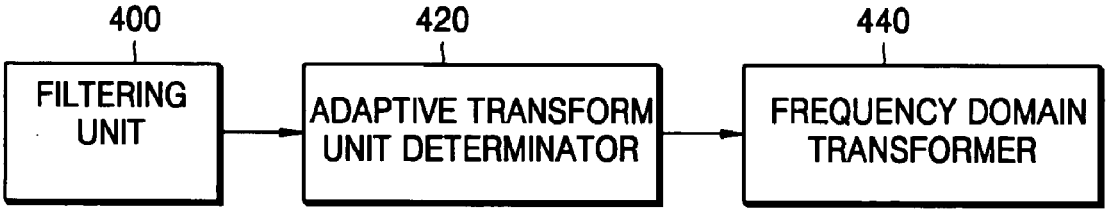
FIG. 14 is a block diagram of an apparatus for transforming an audio signal according to another embodiment of the present invention.

FIG. 14 is a block diagram of an apparatus for transforming an audio signal according to another embodiment of the present invention. The apparatus includes a filtering unit 400, an adaptive transform unit determiner 420, and a frequency-domain transformer 440.

The filtering unit 400 filters the audio signal into predetermined sample units and outputs the result of filtering to the adaptive transform unit determiner 420. The filtering unit 400 filters only required portions of the audio signal according to a frequency band. The predetermined sample units are units into which the sampled audio signal is divided. For instance, the filtering unit 400 divides and filters the audio signal into the predetermined sample units such as those illustrated in FIG. 7.

The adaptive transform unit determiner 420 determines an adaptive transform unit into which the audio signal is to be transformed into the frequency domain when the size of the audio signal becomes greater than a predetermined threshold, and provides the determined adaptive transform unit to the frequency-domain transformer 440. The predetermined threshold is a reference value used in determining whether the audio signal rapidly changes to a large extent. The adaptive transform units are units into which the audio signal can be transformed into a frequency domain while minimizing distortion of the audio signal, determined when the audio signal rapidly changes to a large extent.

Figure 15:
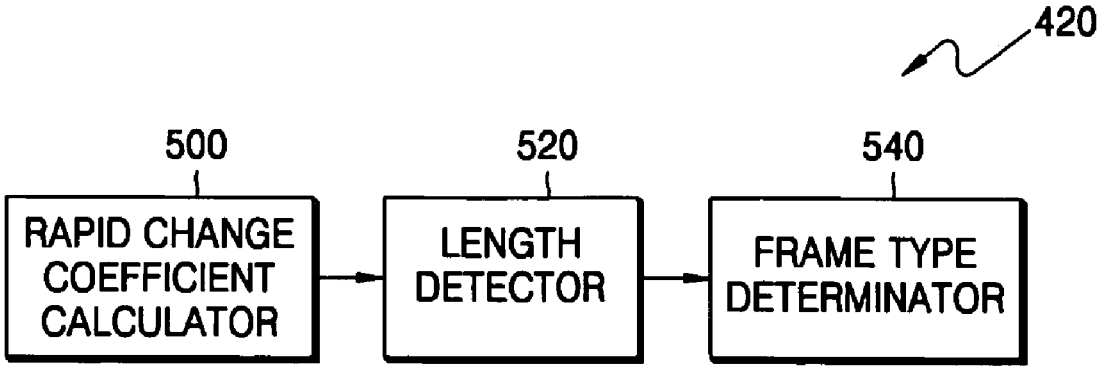
FIG. 15 is a block diagram of an adaptive transforming unit determiner illustrated in FIG. 14.

FIG. 15 is a block diagram of the adaptive transform unit determiner 420. Referring to FIG. 15, the adaptive transform unit determiner 420 includes a rapid change coefficient calculator 500, a length detector 520, and a frame type determiner 540.

The rapid change coefficient calculator 500 computes a rapid change coefficient corresponding to the degree of a change in the audio signal filtered by the filtering unit 400, and provides the rapid change coefficient to the length detector 520. The rapid change coefficient is a reference value used in determining whether the filtered audio signal rapidly changes to a large extent. That the rapid change coefficient is a large value indicates that the audio signal rapidly changes to a large extent at a position where the rapid change coefficient is obtained. The rapid change coefficient calculator 500 computes the rapid change coefficient using Equation (3).

The length detector 520 detects the length of frames of the audio signal that rapidly changes to a large extent when the rapid change coefficient is greater than a predetermined threshold, and outputs the result of detection to the frame type determiner 540. As described above, the predetermined threshold is a reference value used in determining whether the audio signal rapidly changes to a large extent. The rapid change length corresponds to the difference between the positions of the beginning frame of the audio signal and the frame of the audio signal that begins to rapidly change to a large extent in the time domain. When the rapid change coefficient is greater than the predetermined threshold, the audio signal is considered as rapidly changing to a large extent at a position where the rapid change coefficient is obtained. The length detector 520 detects the rapid change length, using Equation (4).

The frame type determiner 540 compares the rapid change length with the sums of the lengths of various types of frames, determines the type of a frame into which the audio signal is to be transformed, and outputs the result of determination to the frequency-domain transformer 440.

If frames are categorized into a super long frame, a long frame, a short frame, and a super short frame, the frame type determiner 540 compares the rapid change length with the sums of the lengths of the frames, and selects one of these frames as an optimum frame into which the audio signal is to be transformed, based on the result of comparison.

The frequency-domain transformer 440 transforms the audio signal into the frequency domain into the adaptive transform units determined by the adaptive transform unit determiner 420.

Figure 16:
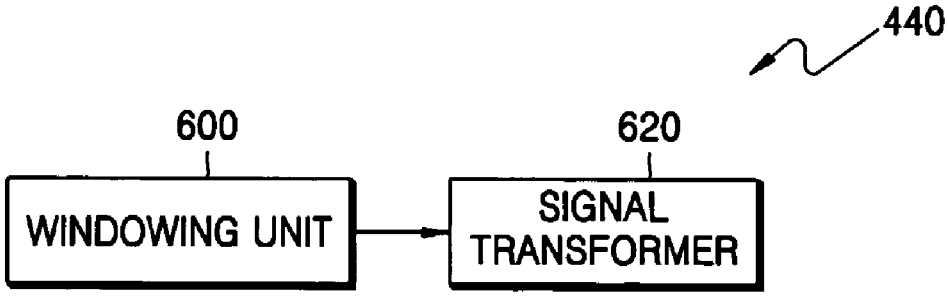
FIG. 16 is a block diagram of a frequency domain transformer illustrated in FIG. 14.

FIG. 16 is a detailed block diagram of the frequency-domain transformer 440 illustrated in FIG. 14. Referring to FIG. 16, the frequency-domain transformer 440 includes a windowing unit 600 and a signal transformer 620.

The windowing unit 600 performs the windowing operation on the audio signal into the determined adaptive transform units, using a window coefficient other than 0, and outputs the result of operation to the signal transformer 620. The window coefficient used by the windowing unit 600 is determined such that the original audio signal is restored through the MDCT that is an inverse transform. Conventionally, the sine window or the Kaiser the sine window coefficient or the Kaiser-Bessel window coefficient used in an audio codec MPEG-4 AAC/BSAC/TwinVQ was used as a window coefficient, but the windowing unit 600 does not use a coefficient of 0. That is, the windowing unit 600 performs the windowing operation on the audio signal into units of a frame corresponding to the adaptive transform units, using a window coefficient other than 0.

The signal transformer 620 transforms the audio signal windowed by the windowing unit 600 into the frequency domain using the DCT or the MDCT.

Figure 17:
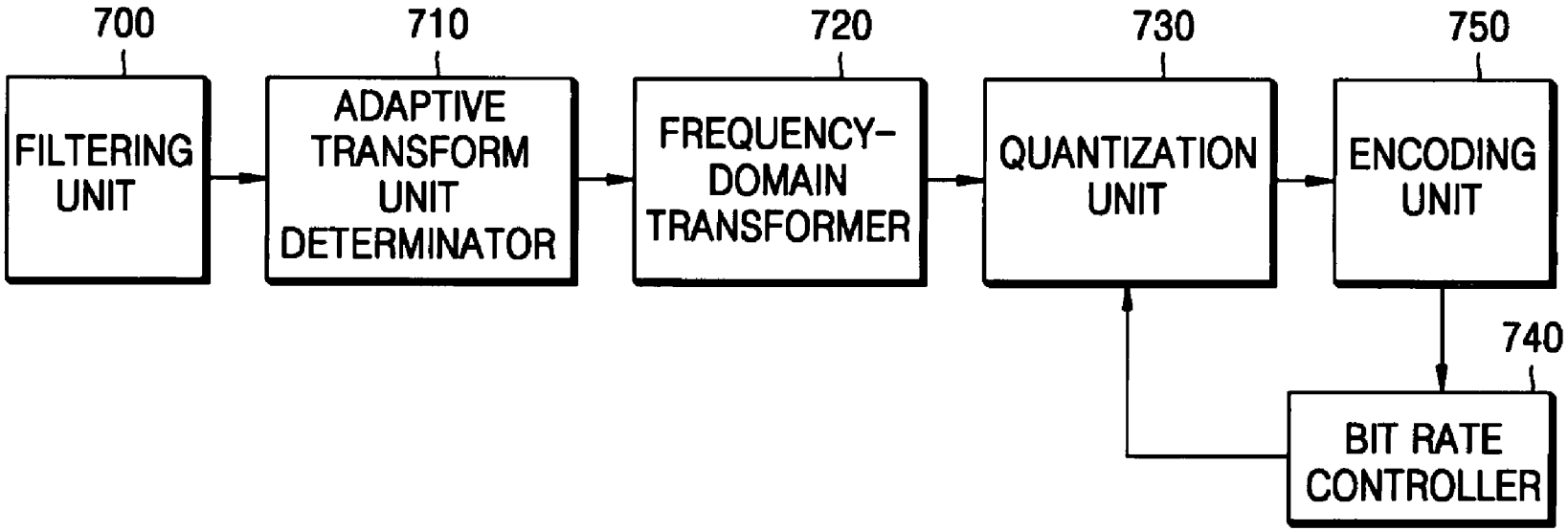
FIG. 17 is a block diagram of an apparatus for adaptively encoding an audio signal according to an embodiment of the present invention.

An apparatus for adaptively transforming an audio signal according to an embodiment of the present invention will now be described with reference to FIG. 17. The apparatus includes a filtering unit 700, an adaptive transform unit determiner 710, a frequency-domain transformer 720, a quantization unit 730, a bit rate controller 740, and an encoding unit 750.

The filtering unit 700 filters the audio signal into predetermined sample units and outputs the result of filtering to the adaptive transform unit determiner 710. The filtering unit 700 filters only required portions of the audio signal according to a frequency band. The operation of the filtering unit 700 is equal to that of the filtering unit 400 and thus will not be described here.

The adaptive transform unit determiner 710 determines adaptive transform units into which the audio signal is to be transformed into a frequency domain when the size of the audio signal is greater than a predetermined threshold, and outputs the result of determination to the frequency-domain transformer 720. The adaptive transform units are units into which the audio signal can be transformed while reducing distortion of the audio signal, determined when the audio signal rapidly changes to a large extent. The operation of the adaptive transform unit determiner 710 is equal to that of the adaptive transform unit determiner 420 and thus will not be described here.

The frequency-domain transformer 720 transforms the audio signal into the frequency domain into the adaptive transform units determined by the adaptive transform unit determiner 710, and outputs the transformed audio signal to the quantization unit 730. The frequency-domain transformer 720 transforms the audio signal into the frequency domain into the determined adaptive transform units, using a window coefficient other than 0. The operation of the frequency-domain transformer 720 is equal to that of the frequency-domain transformer 440 and thus will not be described here.

The quantization unit 730 quantizes the transformed audio signal output from the frequency-domain transformer 720 at an encoding bit rate allocated by the bit rate controller 740, and outputs the result of quantization to the encoding unit 750.

The bit rate controller 740 receives information regarding the bit rate of a bit stream from the encoding unit 750, computes a bit allocation parameter corresponding to the bit rate of the bit stream, and provides the bit allocation parameter to the quantization unit 730. The bit rate controller 740 can minutely adjust the bit rate of a bit stream output from the encoding unit 750 to a desired bit rate.

The encoding unit 750 receives the quantized audio signal from the quantization unit 730 and encodes it into a bit stream. Although not shown, the encoding unit 750 includes a lossless compression unit and a lossy compression unit. In particular, the encoding unit 750 can obtain an appropriate probability distribution of the quantized audio signal and encode the probability distribution using lossless compression such as Huffman coding or arithmetic coding.

A method of inversely transforming an audio signal according to an embodiment of the present invention will now be described. In the method, an audio signal which is encoded into a bit stream into a frequency domain using a window coefficient other than 0 is inversely transformed into a time domain. Use of the window coefficient other than 0 prevents a reduction in an effect of inversely transforming the audio signal.

Figure 18:
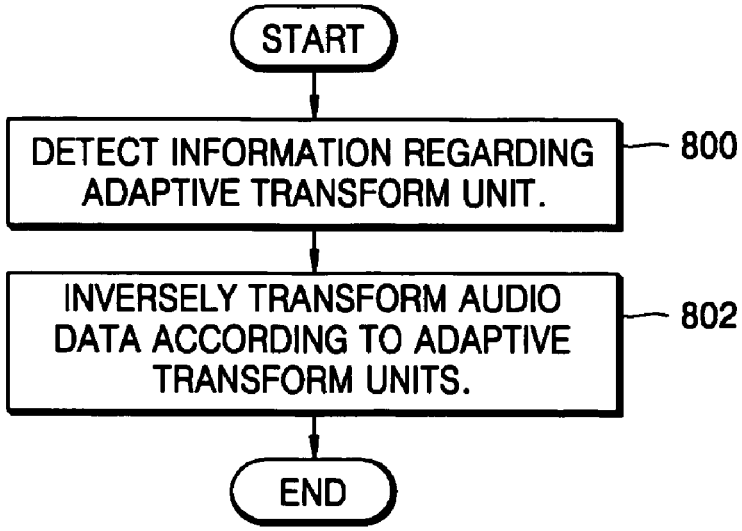
FIG. 18 is a flowchart of a method of inversely transforming an audio signal according to an embodiment of the present invention.

A method of inversely transforming an audio signal according to another embodiment of the present invention will now be described with reference to FIG. 18. Referring to FIG. 18, information regarding an adaptive transform units into which the audio signal was transformed into a frequency domain is obtained from audio data (operation 800). The adaptive transform units are determined according to a change in the size of the audio signal that rapidly changes to a large extent when the audio signal in a time domain is transformed into a frequency domain. The information regarding the adaptive transform units is included in header information when the audio signal is encoded, and obtained from the header information when the audio signal transformed into the frequency domain is inversely transformed in the time domain.

After operation 800, the audio data is inversely transformed into the adaptive transform units according to the information regarding the adaptive transform units (operation 802). In the inverse transform, an audio signal transformed into a frequency domain is inversely transformed in a time domain.

In particular, according to the present embodiment of the present invention, the audio data encoded into the frequency domain using a window coefficient other than 0 is inversely transformed into an audio signal in the time domain into the adaptive transform units.

Figure 19:
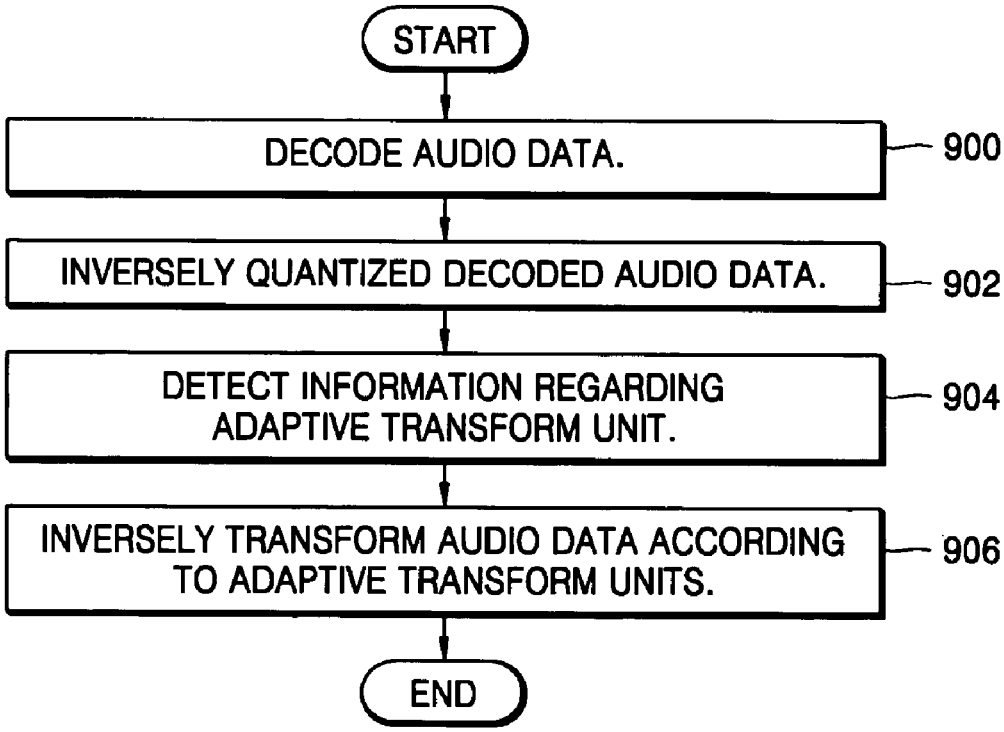
FIG. 19 is a flowchart of a method of adaptively decoding an audio signal according to an embodiment of the present invention.

A method of adaptively decoding an audio signal according to an embodiment of the present invention with reference to FIG. 19. Referring to FIG. 19, encoded audio data is decoded (operation 900). Specifically, an input bit stream is processed in the opposite manner in which the audio data was encoded. If the bit stream is lossy encoded, the bit stream must be losslessly decoded through arithmetic coding or Huffman coding.

After operation 900, the decoded audio data is inversely quantized (operation 902). Through inverse quantization, the decoded audio data is restored to an audio signal with the original size, which has yet to be quantized.

After operation 902, information regarding the adaptive transform units into which the audio signal was transformed into the frequency domain is obtained from the inversely quantized audio data (operation 904). As described above, the adaptive transform units are determined according to a change in the size of the audio signal that rapidly changes to a large extent when the audio signal in a time domain is transformed into a frequency domain. The information regarding the adaptive transform units is included in header information when the audio signal is encoded, and obtained from the header information when the audio signal in the frequency domain is inversely transformed into the time domain.

After operation 904, the audio data is inversely transformed into the adaptive transform units according to the information regarding the determined adaptive transform units (operation 906). Specifically, the inversely quantized audio signal is inversely transformed into the time domain. In particular, the audio data encoded into the frequency domain using a window coefficient other than 0 is inversely transformed into an audio signal in a time domain into the adaptive transform units.

An apparatus for inversely transforming an audio signal according to an embodiment of the present invention will now be described with reference to the accompanying drawings.

Figure 20:
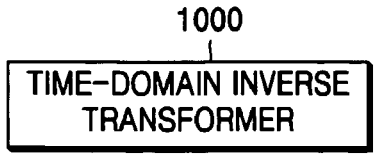
FIG. 20 is a block diagram of an apparatus for inversely transforming an audio signal according to an embodiment of the present invention.

FIG. 20 is a block diagram of a time-domain inverse transformer 1000 that is an apparatus for inversely transforming an audio signal according to an embodiment of the present invention. The time-domain inverse transformer 1000 inversely transforms audio data of a bit stream obtained by transforming an audio signal into a frequency domain using a window coefficient other than 0. In other words, the time-domain inverse transformer 1000 inversely transforms the frequency-domain audio data, which is encoded using the window coefficient other than 0, into a time-domain audio signal.

Figure 21:
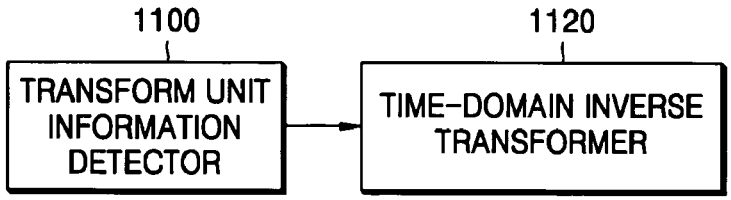
FIG. 21 is a block diagram of an apparatus for inversely transforming an audio signal according to another embodiment of the present invention.

FIG. 21 is a block diagram of an apparatus for inversely transforming an audio signal according to another embodiment of the present invention. The apparatus includes a transform unit information detector 1100 and a time-domain inverse transformer 1120.

The transform unit information detector 1100 detects information regarding adaptive transform units, into which the audio signal was transformed into a frequency domain, from audio data, and outputs the detected information to the time-domain inverse transformer 1120. The adaptive transform units are determined according to a change in the size of the audio signal that rapidly changes to a large extent when transforming the audio signal in a time domain into a frequency domain. The information regarding the adaptive transform units is included in header information when the audio signal is encoded, and obtained from the header information when the audio signal transformed into the frequency domain is inversely transformed in the time domain.

The time-domain inverse transformer 1120 inversely transforms the audio data into the adaptive transform units according to the information regarding the adaptive transform units. The time-domain inverse transformer 1120 transforms the frequency-domain audio signal into a time-domain audio signal into the adaptive transform units. In detail, the time-domain inverse transformer 1120 inversely transforms the audio data, which is a bit stream obtained by transformed an audio signal into the frequency domain using a window coefficient other than 0, into the adaptive transform units.

Figure 22:
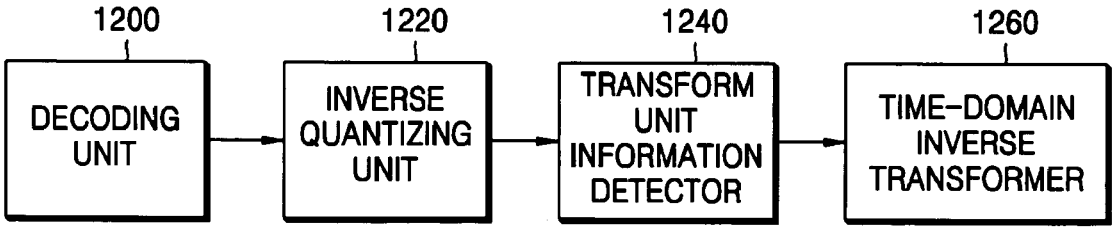
FIG. 22 is a block diagram of an apparatus for adaptively decoding an audio signal according to an embodiment of the present invention.

An apparatus for adaptively decoding an audio signal according to an embodiment of the present invention will now be described with reference to FIG. 22. The apparatus includes a decoding unit 1200, an inverse quantization unit 1220, a transform unit information detector 1240, and a time-domain inverse transformer 1260.

The decoding unit 1200 decodes encoded audio data and outputs the decoded audio data to the inverse quantization unit 1220. That is, the decoding unit 1200 processes an input bit stream in the opposite manner in which an audio signal is encoded by the encoding unit 750. In particular, the decoding unit 1200 decodes a bit stream, which is losslessly encoded, using lossless decoding such as arithmetic decoding or Huffman decoding.

The inverse quantization unit 1220 inversely quantizes the audio data decoded by the decoding unit 1200, and outputs the inversely quantized audio data to the transform unit information detector 1240. That is, the inverse quantizer 1220 restores the decoded audio signal to an audio signal with the original size, which has yet to be quantized.

The transform unit information detector 1240 detects information regarding adaptive transform units, into which the audio signal was transformed into the frequency domain from, the audio data, and outputs the information regarding the adaptive transform units to the time-domain inverse transformer 1260. When the information regarding the adaptive transform units is included into header information when the audio signal is encoded, the transform unit information detector 1240 detects the information regarding the adaptive transform units from the header information.

The time-domain inverse transformer 1260 inversely transforms the audio data into the adaptive transform units according to the information regarding the adaptive transform units. In other words, the time-domain inverse transformer 1260 transforms the frequency-domain audio signal into the time-domain audio signal into the adaptive transform units. In particular, the time-domain inverse transformer 1260 inversely transforms the audio data, which is a bit stream obtained by transforming the audio signal into the frequency domain using a window coefficient other than 0, into the adaptive transform units.

According to the above-described embodiments of present invention, an audio signal is transformed into units of an adaptive frame, which is determined according to a sharp change in the audio signal, into a frequency domain. Accordingly, it is possible to minimize distortion of the audio signal when encoding the audio signal even at a high bit rate while increasing efficiency of compression.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of transforming an audio signal using an audio codec, comprising:

filtering the audio signal into predetermined sample units;

calculating a detected amount of change amount within each of plural sample units, of the predetermined sample units, and measuring a frame length between a frame point of a sample unit of the sample units and a frame point of another of the sample units that has a detected change amount that meets a predetermined threshold;

determining an adaptive transform unit into which a corresponding portion of the audio signal is to be transformed into in a frequency domain to be a select frame type by comparing the measured frame length to a sum of lengths of two different types of frames, wherein the selected frame type has a different length than the sum of lengths of the two different types of frames; and transforming the audio signal into an audio signal in the frequency domain according to determined adaptive transform units.

2. The method of claim 1, wherein the different types of frames comprise a super long frame, a long frame, a short frame, and a super short frame.

3. The method of claim 1, wherein the transforming of the audio signal further comprises:

performing a windowing operation on the audio signal according to the determined adaptive transform units, using a window coefficient other than 0; and transforming the windowed audio signal into the audio signal in the frequency domain.

4. The method of claim 1, wherein the sum of lengths of the two different types of frames is between a length of a super long frame plus a length of a super short frame, a length between a length of a long frame plus the length of the super short frame, or a length between a length of a short frame and the length of the super short frame.

5. The method of claim 1, wherein the sample units each have a length based on a length of a shortest frame type.

6. The method of claim 1, wherein the determining of the adaptive transform unit is performed by comparing the measured frame length to a sum of lengths of a longest frame type and a shortest frame type and based on a length of an immediately previous frame to a frame currently being defined.

7. The method of claim 1, wherein, in the measuring of the frame length between the frame point of the sample unit of the sample units and the frame point of the other of the sample units that has the detected change amount that meets the predetermined threshold, the sample unit is a first sample unit of the predetermined sample units.

8. The method of claim 1, wherein, when the measured frame length is less than the sum of lengths of the two different types of frames, then the measured frame length is compared to another pair of two different types of frames, with at least one of the other pair of two different types of frames being different from the two different types of frames.

9. The method of claim 1, wherein the transforming of the audio signal in a time domain into the audio signal in the frequency domain according to the determined adaptive transform units, using a window coefficient other than 0.

10. A method of transforming an audio signal using an audio codec, comprising:

(a) filtering the audio signal into predetermined sample units;

(b) determining an adaptive transform unit into which the audio signal is to be transformed into an audio signal in a frequency domain based on a change in the audio signal when a detected amount of variance within the audio signal becomes greater than a predetermined threshold; and (c) transforming the audio signal into an audio signal in the frequency domain according to the determined adaptive transform units, wherein operation (b) comprises:

(b1) computing a rapid change coefficient corresponding to a degree that the filtered audio signal is detected to vary, when the adaptive transform unit is a frame;

(b2) detecting a rapid change length, when the rapid change coefficient is greater than the predetermined threshold; and (b3) comparing the rapid change length with the sum of the lengths of various types of frames, and selecting one of various types of frames, wherein the various types of frames comprise a super long frame, a long frame, a short frame, and a super short frame, wherein operation (b3) comprises:

(b31) determining whether the rapid change length is equal to or greater than the sum of the lengths of the super long frame and the super short frame;

(b32) determining whether a previous frame into which the audio signal has been transformed is the super short frame, when the rapid change length is equal to or greater than the sum of the lengths of the super long frame and the super short frame;

(b33) selecting the super long frame when the previous frame is not the super short frame;

(b34) selecting the long frame when the previous frame is the super short frame;

(b35) determining whether the rapid change length is equal to or greater than the sum of the lengths of the long frame and the super short frame, when the rapid change length is less than the sum of the lengths of the super long frame and the super short frame;

(b36) selecting the long frame when the rapid change length is equal to or greater than the sum of the lengths of the long frame and the super short frame;

(b37) determining whether the rapid change length is equal to or greater than the sum of the lengths of the short frame and the super short frame, when the rapid change length is less than the sum of the lengths of the long frame and the super short frame;

(b38) selecting the short frame when the rapid change length is equal to or greater than the sum of the lengths of the short frame and the super short frame; and (b39) selecting the super short frame, when the rapid change length is less than the sum of the lengths of the short frame and the super short frame.

11. A method of adaptively transforming an audio signal using an audio codec, comprising:

filtering the audio signal into predetermined sample units;

determining a detected amount of change amount within each of plural sample units, of the predetermined sample units, and measuring a frame length between a frame point of a sample unit of the sample units and a frame point of another of the sample units that has a detected change amount that meets a predetermined threshold;

determining an adaptive transform unit into which a corresponding portion of the audio signal is to be transformed into a frequency domain to be a select frame type by comparing the measured frame length to a sum of lengths of two different types of frames, wherein the selected frame type has a different length than the sum of lengths of the two different types of frames;

transforming the audio signal into an audio signal in the frequency domain according to determined adaptive transform units;

quantizing the audio signal transformed into the frequency domain according to an encoding bit rate allocated by a bit rate controller; and encoding the quantized audio signal into a bit stream and outputting the bit stream.

12. An audio codec system transforming an audio signal, comprising: an apparatus comprising:

a filtering unit filtering the audio signal into predetermined sample units;

an adaptive transform unit determiner to determine a detected amount of change amount within each of plural sample units, of the predetermined sample units, and measure a frame length between a frame point of a sample unit of the sample units and a frame point of another of the sample units that has a detected change amount that meets a predetermined threshold, and to determine an adaptive transform unit into which a corresponding potion of the audio signal is to be transformed into a frequency domain to be a select frame type by comparing the measured frame length to a sum of lengths of two different types of frames, wherein the selected frame type has a different length than the sum of lengths of the two different types of frames; and a frequency-domain transformer transforming the audio signal into an audio signal in the frequency domain according to determined adaptive transform units.

13. The audio codec system of claim 12, wherein the adaptive transform unit determiner selects one of a super long frame, a long frame, a short frame, and a super short frame as the select frame type into which the audio signal is to be transformed into the frequency domain.

14. The audio codec system of claim 12, wherein the frequency-domain transformer comprises:

a windowing unit performing a windowing operation on the audio signal according to the determined adaptive transform units using a window coefficient other than 0; and a signal transformer transforming the windowed audio signal into the audio signal in the frequency domain.

15. The audio codec system of claim 12, wherein the sum of lengths of the two different types of frames is between a length of a super long frame plus a length of a super short frame, a length between a length of a long frame plus the length of the super short frame, or a length between a length of a short frame and the length of the super short frame.

16. The audio codec system of claim 12, wherein the sample units each have a length based on a length of a shortest frame type.

17. The audio codec system of claim 12, wherein the determining of the adaptive transform unit is performed by comparing the measured frame length to a sum of lengths of a longest frame type and a shortest frame type and based on a length of an immediately previous frame to a frame currently being defined.

18. The audio codec system of claim 12, wherein, in the measuring of the frame length between the frame point of the sample unit of the sample units and the frame point of the other of the sample units that has the detected change amount that meets the predetermined threshold, the sample unit is a first sample unit of the predetermined sample units.

19. The audio codec system of claim 12, wherein, when the measured frame length is less than the sum of lengths of the two different types of frames, then the measured frame length is compared to another pair of two different types of frames, with at least one of the other pair of two different types of frames being different from the two different types of frames.

20. The audio codec system of claim 12, wherein the frequency-domain transformer transforms the audio signal in a time domain into an audio signal in the frequency domain according to the determined adaptive transform units, using a window coefficient other than 0.

21. An audio codec system adaptively encoding an audio signal, comprising: an apparatus comprising:

a filtering unit filtering the audio signal into predetermined sample units;

an adaptive transform unit determiner to determine a detected amount of change amount within each of plural sample units, of the predetermined sample units, and measure a frame length between a frame point of a sample unit of the sample units and a frame point of another of the sample units that has a detected change amount that meets a predetermined threshold, and to determine an adaptive transform unit into which a corresponding portion of the audio signal is to be transformed into the frequency domain to be a select frame type by comparing the measured frame length to a sum of lengths of two different types of frames, wherein the selected frame type has a different length than the sum of lengths of the two different types of frames;

a frequency-domain transformer transforming the audio signal into an audio signal in the frequency domain according to the determined adaptive transform units;

a quantization unit quantizing the audio signal transformed into the frequency domain;

a bit rate controller controlling the bit rate of the audio signal to be quantized; and an encoding unit encoding the quantized audio signal into a bit stream and outputting the bit stream.

22. A method of inversely transforming an audio signal using a hardware audio codec, comprising:

detecting information regarding an adaptive transform unit of the audio signal transformed into a frequency domain through a non-oversampling window frequency domain transformation, from audio data; and inversely transforming the audio data according to the adaptive transform units of the detected information, wherein the adaptive transform unit is determined by determining a detected amount of change amount within each of plural sample units and measuring a frame length between a frame point of a sample unit of the sample units and a frame point of another of the sample units that has a detected change amount that meets a predetermined threshold, and by determining the adaptive transform unit to be a select frame type by comparing the measured frame length to a sum of lengths of two different types of frames, wherein the selected frame type has a different length than the sum of lengths of the two different types of frames, and wherein during the inversely transforming of the audio data, the audio data, which is a bit stream of the audio signal transformed into the frequency, is inversely transformed according to the adaptive transform units.

23. The method of claim 22, wherein the inversely transforming of the audio data inversely transforms the audio data according to the adaptive transform units of the detected information, using a window coefficient other than 0.

24. A method of decoding an audio signal using a hardware audio codec, comprising:

decoding encoded audio data;

inversely quantizing the decoded audio data according to an encoding bit rate allocated by a bit rate controller used in an encoding of the audio signal;

detecting information regarding an adaptive transform unit of the audio signal transformed into a frequency domain through a non-oversampling window frequency domain transformation, from the inversely quantized audio data; and inversely transforming the audio data according to the adaptive transform units of the detected information, wherein the adaptive transform unit is determined by determining a detected amount of change amount within each of plural sample units and measuring a frame length between a frame point of a sample unit of the sample units and a frame point of another of the sample units that has a detected change amount that meets a predetermined threshold, and by determining the adaptive transform unit to be a select frame type by comparing the measured frame length to a sum of lengths of two different types of frames, wherein the selected frame type has a different length than the sum of lengths of the two different types of frames, and wherein during the inversely transforming of the audio data, the audio data, which is a bit stream of the audio signal transformed into the frequency domain, is inversely transformed according to the adaptive transform units.

25. An audio codec system inversely transforming an audio signal, comprising: an apparatus comprising:

a transform unit information detector detecting information regarding an adaptive transform unit of the audio signal transformed into a frequency domain through a non-oversampling window frequency domain transformation, from audio data; and a time-domain inverse transformer inversely transforming the audio data according to the adaptive transform units of the detected information, wherein the adaptive transform unit is determined by determining a detected amount of change amount within each of plural sample units and measuring a frame length between a frame point of a sample unit of the sample units and a frame point of another of the sample units that has a detected change amount that meets a predetermined threshold, and by determining the adaptive transform unit to be a select frame type by comparing the measured frame length to a sum of lengths of two different types of frames, wherein the selected frame type has a different length than the sum of lengths of the two different types of frames, and wherein the time-domain inverse transformer inversely transforms the audio data, which is a bit stream of the audio signal transformed into the frequency domain, according to the adaptive transform units.

26. The audio codec system of claim 25, wherein the time-domain inverse transformer inversely transforms the audio data according to the adaptive transform units of the detected information, using a window coefficient other than 0.

27. An audio codec system adaptively decoding an audio signal, comprising: an apparatus comprising:

a decoding unit decoding encoded audio data;

an inverse quantization unit inversely quantizing the decoded audio data according to an encoding bit rate allocated by a bit rate controller used in an encoding of the audio signal;

a transform unit information detector detecting information regarding an adaptive transform unit of the audio signal transformed into a frequency domain through a non-oversampling window frequency domain transformation, from the inversely quantized audio data; and a time-domain inverse transformer inversely transforming the audio data according to the adaptive transform units of the detected information, wherein the adaptive transform unit is determined by determining a detected amount of change within each of plural sample units and measuring a frame length between a frame point of a sample unit of the sample units and a frame point of another of the sample units that has a detected change amount that meets a predetermined threshold, and by determining the adaptive transform unit to be a select frame type by comparing the measured frame length to a sum of lengths of two different types of frames, wherein the selected frame type has a different length than the sum of lengths of the two different types of frames, and wherein the time-domain inverse transformer inversely transforms the audio data, which is a bit stream of the audio signal transformed into the frequency domain, according to the adaptive transform units.

28. A method of transforming an audio signal using an audio codec, comprising:

determining a detected amount of change within each of plural sample units and measuring a frame length between a frame point of a sample unit of the sample units and a frame point of another of the sample units that has a detected change amount that meets a predetermined threshold;

determining an adaptive transform unit, for transforming the audio signal into a frequency domain, to be a select frame type by comparing the measured frame length to a sum of lengths of two different types of frames, wherein the selected frame type has a different length than the sum of lengths of the two different types of frames; and transforming the audio signal in a time domain into the audio signal in the frequency domain according to determined transform units, without audio oversampling.

29. An audio codec system transforming an audio signal, comprising: an apparatus comprising:

a transform unit determiner determining a detected amount of change within each of plural sample units and measuring a frame length between a frame point of a sample unit of the sample units and a frame point of another of the sample units within that has a detected change amount that meets a predetermined threshold, and determining an adaptive transform unit, for transforming the audio signal into a frequency domain, to be a select frame type by comparing the measured frame length to a sum of lengths of two different types of frames, wherein the selected frame type has a different length than the sum of lengths of the two different types of frames; and a frequency-domain transformer transforming the audio signal in a time domain into an audio signal in the frequency domain according to determined transform units, without audio oversampling.

30. A method of inversely transforming an audio signal using an audio codec, comprising:

inversely transforming an audio data which is a bit stream of the audio signal transformed into a frequency domain according to a transform unit without audio oversampling, wherein the transform unit is determined by determining a detected amount of change within each of plural sample units and measuring a frame length between a frame point of a sample unit of the sample units and a frame point of another of the sample units that has a detected change amount that meets a predetermined threshold, and determining the transform unit, for transforming the audio signal into the frequency domain, to be a select frame type by comparing the measured frame length to a sum of lengths of two different types of frames, wherein the selected frame type has a different length than the sum of lengths of the two different types of frames, and wherein the inversely transforming of the audio signal is based upon information in the bit stream indicating a respective single window operation having been performed on each of respective plural defined frame units of the audio signal in a time domain, the plural frame units including non-oversampled audio data.

31. An audio codec system inversely transforming an audio signal, comprising: an apparatus comprising:

a time-domain inverse transformer inversely transforming audio data which is a bit stream of the audio signal transformed into a frequency domain according to a transform unit without audio oversampling, wherein the transform unit is determined by determining a detected amount of change within each of plural sample units and measuring a frame length between a frame point of a sample unit of the sample units and a frame point of another of the sample units that has a detected change amount that meets a predetermined threshold, and determining the transform unit, for transforming the audio signal into the frequency domain, to be a select frame type by comparing the measured frame length to a sum of lengths of two different types of frames, wherein the selected frame type has a different length than the sum of lengths of the two different types of frames, wherein the inversely transforming of the audio signal is based upon information in the bit stream indicating a respective single window operation having been performed on each of respective plural defined frame units of the audio signal in a time domain, the plural frame units including non-oversampled audio data.

* * * * *

UNITED STATES PATENT AND TRADEMARK OFFICE

CERTIFICATE OF CORRECTION

PATENT NO. : 8,086,446 B2
APPLICATION NO. : 11/295648
DATED : December 27, 2011
INVENTOR(S) : Eunmi Oh et al.

It is certified that error appears in the above-identified patent and that said Letters Patent is hereby corrected as shown below:

Column 15, Line 57, In Claim 1, delete "into in a" and insert -- into a --, therefor.

Column 17, Line 65, In Claim 12, delete "potion" and insert -- portion --, therefor.

Signed and Sealed this
Nineteenth Day of June, 2012

David J. Kappos

David J. Kappos
*Director of the United States Patent and Trademark Office*